US005732633A

United States Patent [19]

Herskowits

[11] Patent Number: 5,732,633

[45] Date of Patent: Mar. 31, 1998

[54] APPARATUS AND METHOD FOR PRINTING

[75] Inventor: Floreta Herskowits, Petach Tikva, Israel

[73] Assignee: Nur Advanced Technologies, Ltd., Petach Tikva, Israel

[21] Appl. No.: 627,437

[22] Filed: Apr. 4, 1996

[51] Int. Cl.[6] ..... B41F 23/04

[52] U.S. Cl. ..... 101/487; 101/424.1; 347/102

[58] Field of Search ..... 101/424.1, 487, 101/416.1; 34/255, 256, 257, 258; 347/37, 39, 102

[56] References Cited

U.S. PATENT DOCUMENTS

| | | | |
|---|---|---|---|
| 3,329,796 | 7/1967 | Manwaring | 219/775 |
| 4,566,014 | 1/1986 | Paranjpe et al. | 346/1.1 |
| 4,638,571 | 1/1987 | Cook | 34/1 |
| 4,686,540 | 8/1987 | Leslie et al. | 346/33 |
| 4,903,592 | 2/1990 | Ericsson | 101/115 |
| 4,911,071 | 3/1990 | Svantesson | 101/129 |
| 5,174,864 | 12/1992 | Arbizzani et al. | 202/175 |
| 5,212,498 | 5/1993 | Sugimori | 346/25 |

*Primary Examiner*—Edgar S. Burr
*Assistant Examiner*—Dave Ghatt
*Attorney, Agent, or Firm*—Wilson Sonsini Goodrich & Rosati

[57] ABSTRACT

A printing system is provided which includes a printing head for applying at least one ink to a printing substrate and at least one radio frequency (RF) drying unit for discharging RF energy, thereby drying the ink on the printing substrate. A printing system is also provided which includes a printing and drying head for applying at least one ink to a printing substrate and for subsequently drying it. The printing system further includes means for moving the printing head with respect to the printing substrate.

19 Claims, 4 Drawing Sheets

APPARATUS AND METHOD FOR PRINTING

FIELD OF THE INVENTION

The present invention relates to printing systems generally and more particularly to printing systems which employ relatively slow drying inks, such as water based inks.

BACKGROUND OF THE INVENTION

Printing systems which employ relatively slow drying inks for printing, such as printing systems which employ water based inks, are well known in the art. Unfortunately, slow drying inks dry slowly on printing substrates in general and on impervious printing substrates, such as vinyl, in particular. Another drawback of slow drying inks is color bleeding, i.e. the mixing on the printing substrate, of one color with a formerly applied color that has not completely dried.

Therefore, prior art printing systems which employ water based inks are limited in their printing rates and printing quality.

However, such printing systems are more environmentally friendly and do not contain volatile organic carbon components which may be hazardous.

SUMMARY OF THE INVENTION

It is an object of the present invention to provide an improved printing system.

According to one aspect of the present invention, there is provided a printing system which employs radio frequency (RF) radiation for drying the applied ink after it has been applied to the printing substrate, preferably immediately thereafter.

According to one aspect of the present invention, there is provided a printing system which employs RF radiation for "on-the-fly" drying of the ink (i.e. as the ink is applied to the printing substrate.)

According to a further aspect of the present invention, there is provided a printing system which employs RF radiation for drying ink waste residues generated during the operation of the printing system.

There is thus provided, in accordance with a preferred embodiment of the present invention, a printing system which includes a printing head for applying at least one ink to a printing substrate and at least one radio frequency (RF) drying unit for discharging RF energy, thereby drying the at least one ink on the printing substrate.

There is also provided, in accordance with a preferred embodiment of the present invention, a printing system which includes a printing and drying head for applying at least one ink to a printing substrate and for subsequently drying it and means for moving the printing head with respect to the printing substrate.

Further, according to a preferred embodiment of the present invention, the printing and drying head includes at least one printing element for applying one of the at least one ink on the printing substrate and at least one RF drying unit for discharging RF energy, thereby drying one of the at least one ink.

Still further, according to a preferred embodiment of the present invention the at least one RF unit includes an RF generator for producing RF energy and at least one electrode for discharging the RF energy in the vicinity of the printing substrate.

According to one preferred embodiment of the present invention, the at least one electrode includes a positive and a negative electrode located on the same side of the printing substrate.

Alternatively, the at least one electrode includes a positive and a negative electrode located on opposite sides of the printing substrate.

Additionally, according to a preferred embodiment of the present invention the printing system includes an ink waste disposal system which includes a collection unit for collecting the ink residues and an RF waste ink drying unit for discharging RF energy, thereby to vaporize the ink so as to produce a substantially solid ink residue for disposal.

Further, according to a preferred embodiment of the present invention, the ink waste drying RF unit includes an RF generator for producing RF energy and at least one electrode for discharging the RF energy towards the collection unit.

In accordance with a preferred embodiment of the present invention, the same RF generator generates RF energy for the at least one electrode of the RF drying unit and for the at least one electrode of the RF waste ink drying unit.

There is also provided, in accordance with a preferred embodiment of the present invention, a printing system which includes means for applying ink on a printing substrate and an ink waste disposal system which includes a collection vessel for collecting the ink residues and an RF unit for generating RF energy, thereby to vaporize the ink so as to produce a substantially solid ink residue for disposal.

According to a preferred embodiment of the present invention, the at least one ink is a water based ink.

There is also provided, in accordance with a preferred embodiment of the present invention a printing method which includes the steps of:

a. applying at least one ink to a printing substrate; and
b. discharging RF energy, thereby drying the at least one ink on the printing substrate.

There is also provided, according to a preferred embodiment of the present invention a printing method which includes the steps of:

a. applying at least one ink to a portion of a printing substrate;
b. moving the printing head with respect to the printing substrate; and
c. discharging RF energy, thereby drying the ink applied on the portion of the printing substrate.

Further, according to one preferred embodiment of the present invention the printing method includes the steps of:

a. collecting into a collection unit ink residues; and
b. discharging RF energy towards the collection unit, thereby vaporizing said ink residues, thereby obtaining a substantially solid ink residue for disposal.

Additionally, there is provided, according to a preferred embodiment of the present invention, a method for collecting ink residues of a printing system which includes the steps of:

a. collecting into a collection unit said ink residues; and
b. discharging RF energy towards said collection unit, thereby to vaporize said ink so as to produce a substantially solid ink residue for disposal.

Finally, according to a preferred embodiment of the present invention the at least one ink is a water based ink.

BRIEF DESCRIPTION OF THE DRAWINGS

The present invention will be understood and appreciated more fully from the following detailed description taken in conjunction with the appended drawings in which.

DETAILED DESCRIPTION OF THE PRESENT INVENTION

Figure 1:
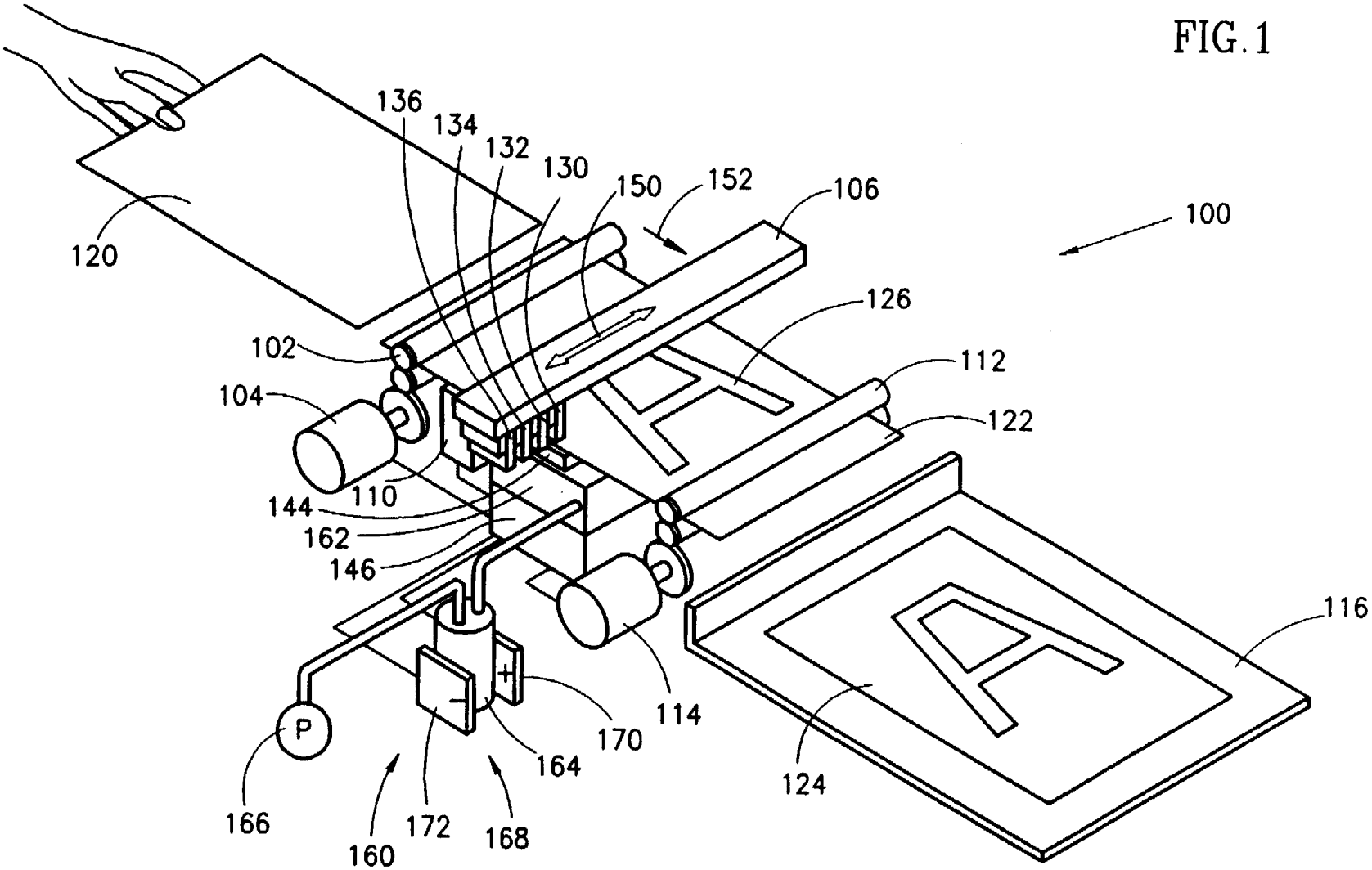
FIG. 1 is a schematic isometric illustration of a printing system, constructed and operative according to a preferred embodiment of the present invention.
Figure 2A:
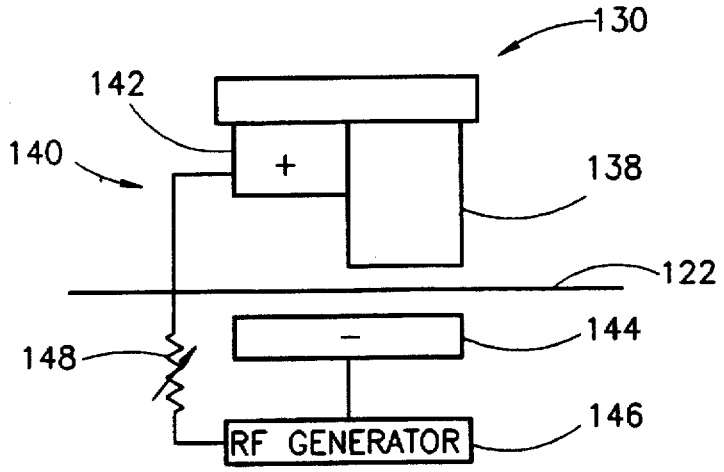
FIGS. 2A and 2B are schematic cross section illustrations of one color printing unit of the printing head of the printing system of FIG. 1, constructed and operative according to two preferred embodiments of the present invention.
Figure 2B:
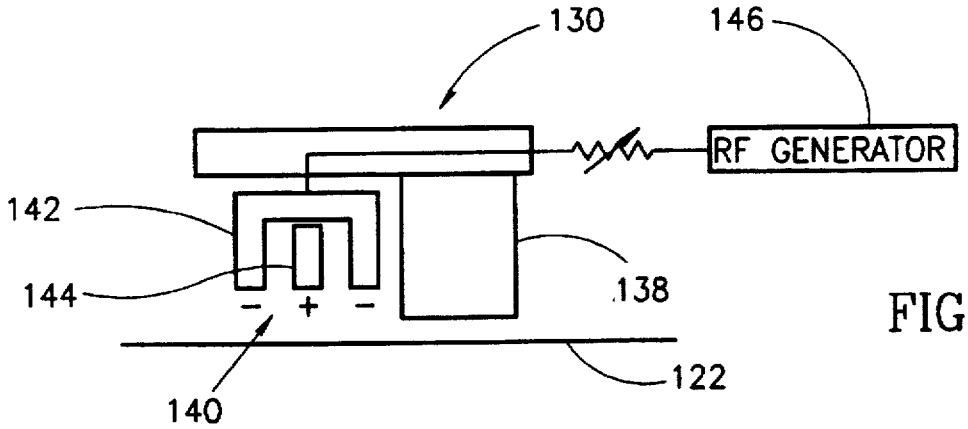
Figure 3A:
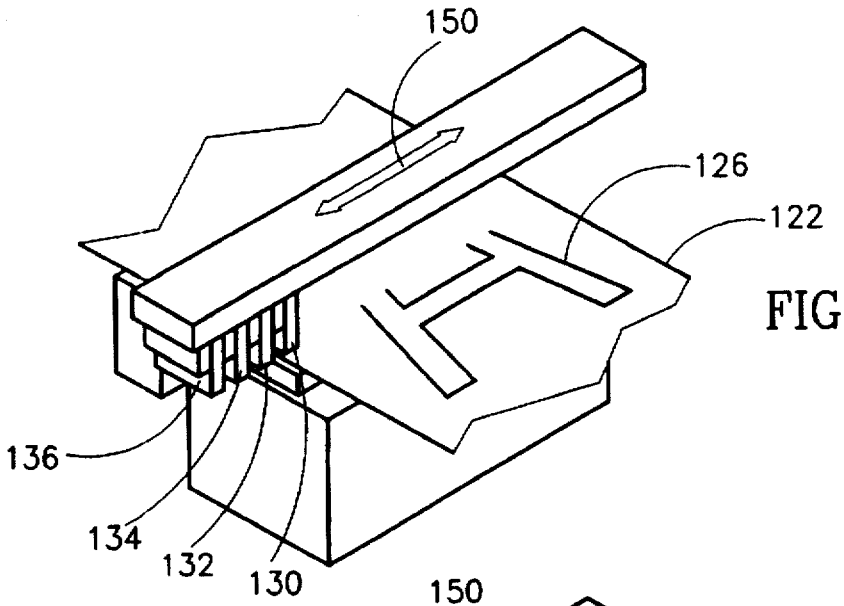
FIGS. 3A–3C are schematic illustration of the printing head of the printing system of FIG. 1 in three printing positions.
Figure 3B:
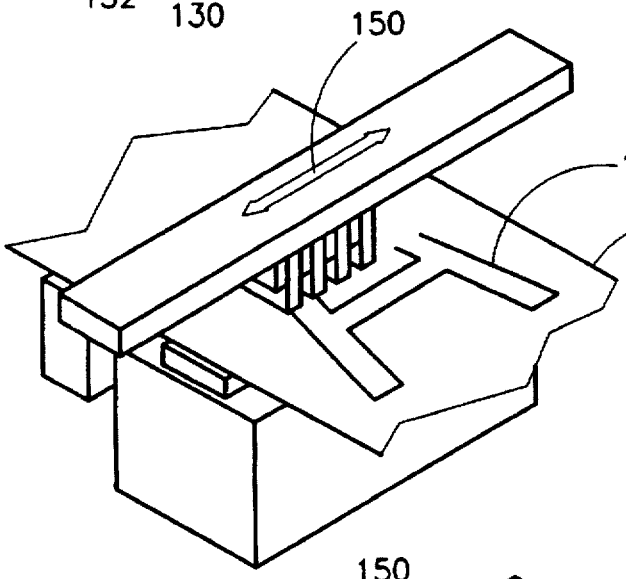
Figure 3C:
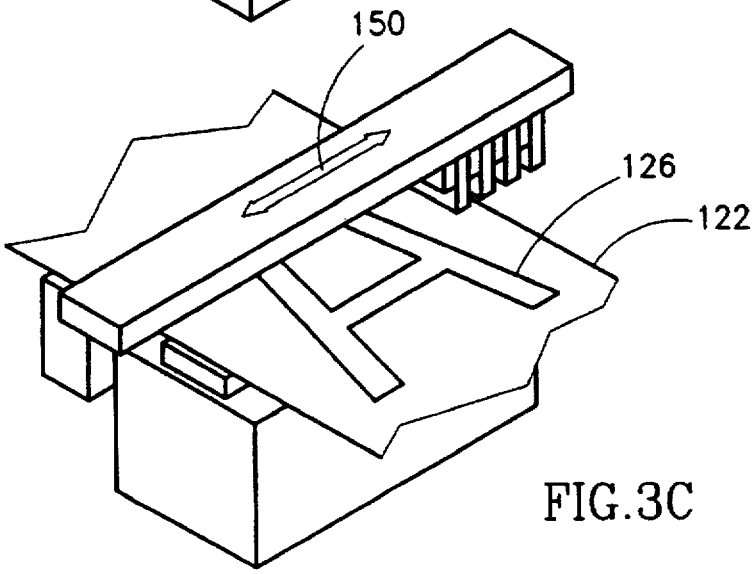

Reference is now made to FIGS. 1–3C which illustrate a printing system, referenced generally 100, constructed and operative in accordance with a preferred embodiment of the present invention. FIG. 1 is a schematic isometric illustration of the printing system 100, FIGS. 2A and 2B are schematic cross section illustrations of one color printing unit of the printing head of the printing system 100, according to two alternative embodiments of the present invention and FIGS. 3A–3C are schematic illustration of the printing head of the printing system 100 in three printing positions. Similar elements are referenced in FIGS. 1–3C by similar reference numerals.

The printing system 100, may be any printing system, such as an ink-jet printing system. An example of an ink-jet printing system is the SCITEX OUTBOARD printer which is a large format continuous ink-jet printer used, for example, for billboard printing and which is commercially available from Scitex Corporation Ltd. of Herzlia, Israel.

The printing system 100 is a printing system which employs water based inks and includes an "on-the-fly" drying system for drying the inks applied to the printing substrate during printing. The printing system 100 selectively dries the inks applied to the printed substrate.

The printing system 100 preferably comprises any feed-in mechanism, such as rollers 102 operated by a motor 104, for feeding substrates to be printed into a printing position, a printing head 106 for printing an image on a printing substrate with a water based ink and for drying it thereafter, and a Central Processing Unit (CPU) 110 for controlling the operation of the printing system 100.

The system 100 also preferably comprises a feed-out mechanism, such as rollers 112 operated by a motor 114, and a collector 116 for collecting the printed substrates after printing.

For exemplary purposes only, and as a non-limiting embodiment, the printing system 100 will be described with respect to sheets of paper such as the sheet illustrated in three different positions indicated by reference numerals 120, 122 and 124. Reference numeral 120 indicates the printed substrate before it is fed into the printing system 100, reference numeral 122 indicates the printed sheet in a printing position and reference numeral 124 indicates the sheet in the collection system 116 after it has been printed.

It will be appreciated that the printing system 100 may be fed with any suitable substrate to be printed, such as paper or plastic, in any suitable form, such as a continuous roll of paper, and in any format.

The printing head 106 preferably includes four printing units 130, 132, 134 and 136, each of which prints one of the four process colors Cyan, Magenta, Yellow and Black (CMYK) on the printed sheet and subsequently dries it "on-the-fly".

As best seen from FIGS. 2A and 2B, which for exemplary purposes only refer to the printing unit 130, each printing unit preferably includes a printing element 138 and an RF drying element, generally referenced 140. As described in more detail hereinbelow, each one of the printing units 130, 132, 134 and 136 operates to print and to subsequently dry, "on-the-fly", the ink printed on the sheet 122.

Preferably, each one of the RF drying elements comprises a positive electrode and a negative electrode, referenced 142 and 144, respectively. Each one of the drying units are connected in parallel to an RF generator 146, which generates RF radiation and any suitable controller, such as the resistor 148, for controlling the RF output level.

According to one preferred embodiment of the present invention, as illustrated in FIG. 2A, the positive electrode 142 is on one side of the printing sheet 122 whereas the negative electrode 144 is on its other side. Alternatively, as illustrated in FIG. 2B, both the negative electrode 142 and the positive electrode 144 are on the same side of the printing sheet 122, which is the side of the printing element 138.

As best seen in FIGS. 3A–3C, the image 126 is printed on the printing substrate 122 in a step wise fashion. During printing, while the printing elements discharge water based ink on the printing sheet 122 to form portions of the image 126, each one of the RF drying elements 140 (FIGS. 2A, 2B), outputs a suitable level of RF output to dry ink previously discharged by its corresponding printing unit. It will be appreciated that as best seen in FIGS. 3A–3C, each RF drying unit (140, FIGS. 2A, 2B) is behind the printing element of one of the printing units 130, 132, 134 and 136.

In the illustrated embodiment, the printing head 106 moves in one direction indicated by arrow 150, for printing a strip across the printed sheet 122 and after each strip is being printed, the sheet 122 moves one step forward in a generally perpendicular direction 152 to the direction 150 to provide the next strip of the sheet 122 for printing. FIGS. 3A, 3B and 3C illustrate the printing head 106 before, during and after printing one strip, respectively.

Preferably, each one of the printing steps of the printing head 106 corresponds to the size of the printing elements 138. Referring again for exemplary purposes to the printing unit 130, the printing element 138 discharges cyan ink on the first portion of the strip currently being printed which includes the image. Then, the printing unit moves one step, such that electrode 142 of its respective RF element 140 is above the area covered in the previous step by the printing element 138. Then, the printing element 138 discharges ink on a second portion of the strip while electrode 142 of its respective RF element 140 dries the ink previously discharged by the printing element 138. The printing elements and RF drying elements of the printing units 132, 134 and 136 operates in a similar fashion in sequence after the printing unit 130.

Since it is environmentally advantageous to dispose ink residues not in the liquid state but in the solid state, the printing system 100 preferably also include a RF waste ink drying system 160 (FIG. 1). The system 160 preferably includes a collection system 162 for collecting ink liquid residues in a collection vessel 164 and a pump 166 for collecting the ink's vapors, such as water vapor resulting from the ink vaporization process. The ink residues are produced during cleaning and maintenance of the printing system 100.

It is a particular feature of the present invention that the system 160 also includes an RF drying element 168, which includes positive and negative electrodes, referenced 170 and 172, respectively, for improving the ink residue drying process in the collection vessel 164. The RF drying element 168 operates similarly to the drying elements 140 of the printing units. Preferably, but not necessarily, the RF generator 146 also provides RF radiation in the desired level to the RF drying element 168.

Figure 5:
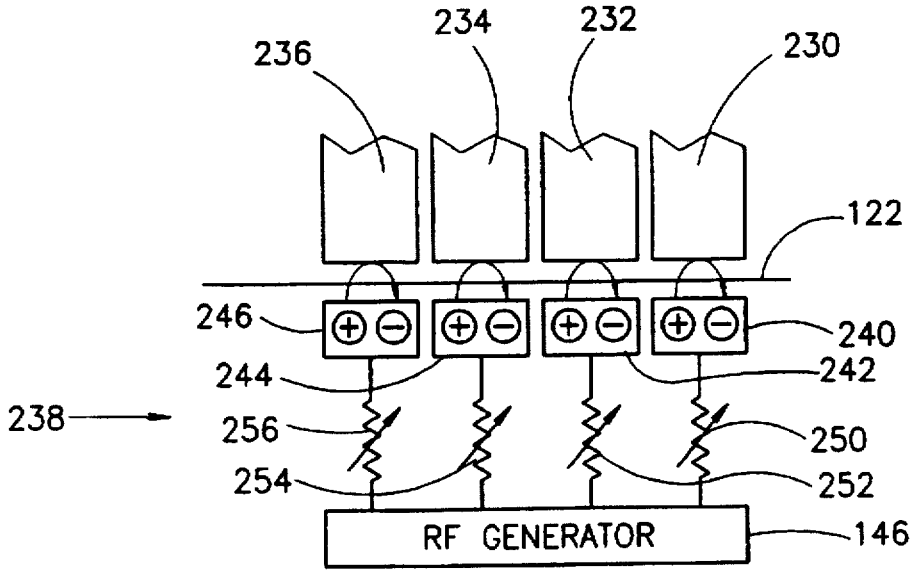
FIG. 5 is a schematic cross section illustration of the printing head of the printing system of FIG. 4.
Figure 4:
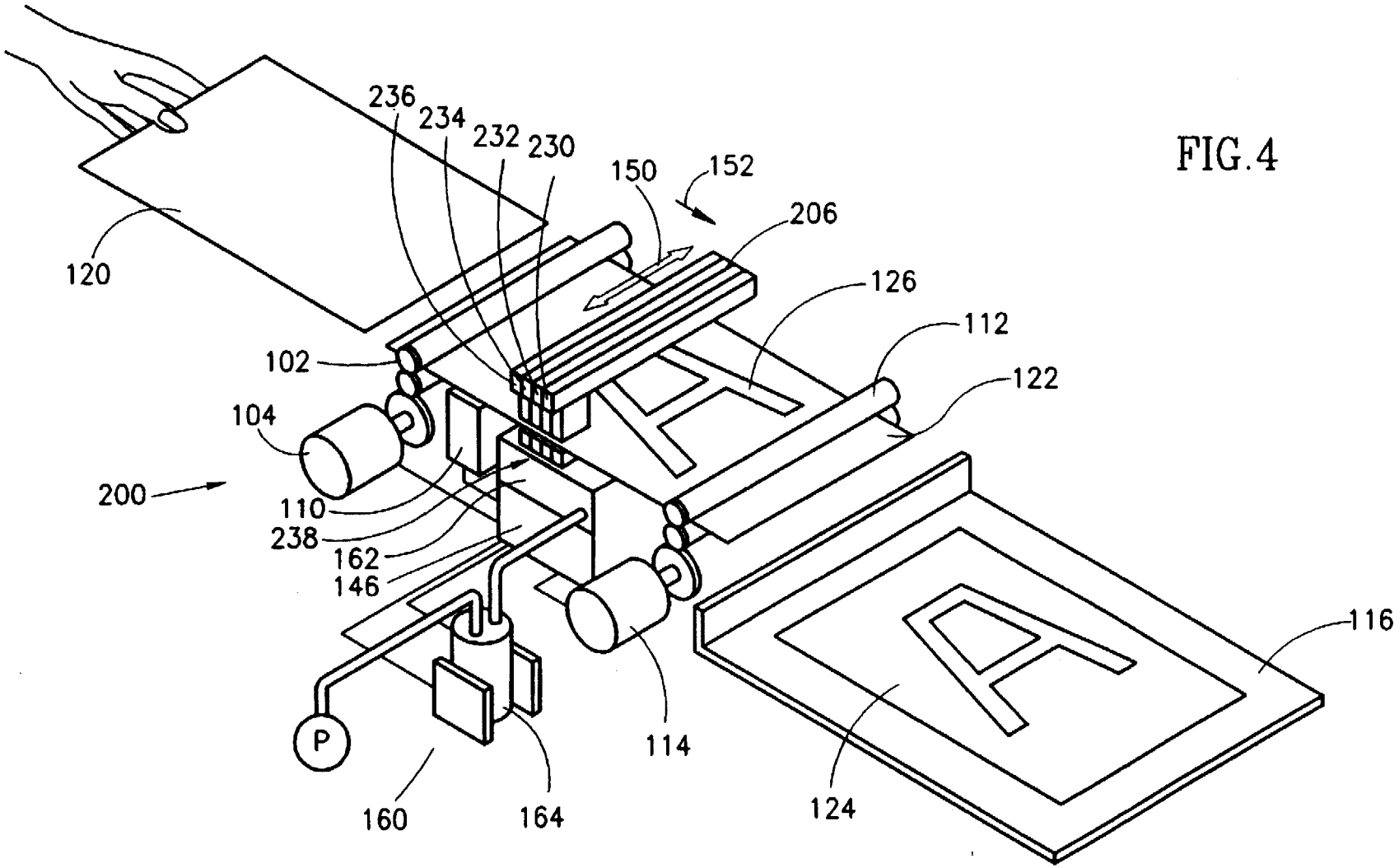
FIG. 4 is a schematic isometric illustration of a printing system, constructed and operative according to another preferred embodiment of the present invention.

Reference is now made to FIGS. 4–5 which illustrate a printing system, similar to the printing system 100, but which employs a different printing head and a different RF drying system associated therewith. Similar reference numerals are used to indicate elements in FIGS. 4 and 5 which are similar to those in FIGS. 1–3C.

In the illustrated embodiment, printing and drying are sequential and not simultaneous as described with respect to the embodiments of FIGS. 1–3C.

The printing head 206 of the system 200 illustrated in FIGS. 4 and 5, generally referenced 200, preferably includes four printing units 230, 232, 234 and 236, each of which preferably prints one of the four process colors CMYK and an RF drying unit 238 which includes four RF drying units 240, 242, 244 and 246 (FIG. 5), each of which includes a positive and a negative electrode. Preferably, each one of the RF drying units outputs RF radiation which is suitable for drying a corresponding ink. For example, in the illustrated embodiment, the Rf drying unit 240 operates to dry ink discharged by the printing unit 230 which discharges Cyan ink.

As best seen from FIG. 5, each pair of corresponding printing unit and drying unit, such as the printing unit 232 and the drying unit 242 are located generally in the same position, each on one side of the printing sheet 122. Preferably, the length of the RF units 240, 242, 244 and 246 is generally similar to the width of the printing sheet 122.

During printing, the four printing units 230, 232, 234 and 236 discharge CMYK inks simultaneously to cover a portion of a strip of the printing sheet 122. Preferably, the printing units 230, 232, 234 and 236 operate in a step wise fashion by moving along the direction indicated by arrow 150. Once a strip is printed, the RF generator 146 outputs RF radiation which is modulated to the desired level by each one of the suitable controllers, such as the resistors 250, 252, 254 and 256, each of which controls the RF output level in accordance with the properties of the corresponding ink to be dried.

Then, the printing sheet 122 moves one step in the direction indicated by the arrow 152 and another strip is printed.

It will be appreciated that, since each point on the printing sheet 122 is printed typically by four printing colors, the steps of the sheet 122 in the direction 152 are such that a new strip includes a portion of the previous strip which has not been yet printed with all the desired printing inks.

It will be appreciated that the preferred embodiments described hereinabove are described by way of example only and that numerous modifications thereto, all of which fall within the scope of the present invention, exist. For example, the present invention is not limited to CMYK inks and any additional ink or a substitute for one of the CMYK colors may be employed.

It will be appreciated by persons skilled in the art that the present invention is not limited to what has been particularly shown and described hereinabove. Rather, the scope of the present invention is defined only by the claims that follow:

I claim:

1. A printing system comprising:

a. a printing head including an ink jet printing element for applying at least one liquid ink to a printing substrate; and b. at least one radio frequency (RF) drying unit carried by said printing head adjacent to said ink jet printing element for generating RF energy to dry said liquid ink immediately after it has been applied to said printing substrate.

2. A printing system according to claim 1 wherein said at least one RF drying unit comprises:

a. an RF generator for producing RF energy; and b. at least one electrode for discharging said RF energy in the vicinity of said printing substrate.

3. A printing system according to claim 2 wherein said at least one electrode comprises a positive electrode and a negative electrode located on the same side of said printing substrate.

4. A printing system according to claim 2 wherein said at least one electrode comprises a positive electrode and a negative electrode located on opposite sides of said printing substrate.

5. A printing system according to claim 1 further comprising an ink waste disposal system comprising:

a. a collection unit for collecting ink liquid residues; and b. an RF ink waste drying unit for discharging RF energy to convert said ink liquid residues to a substantially solid ink residue for disposal.

6. A printing system according to claim 5 wherein said RF ink waste drying unit comprises: and a. an RF generator for producing RF energy;

b. at least one electrode for discharging said RF energy towards said collection unit.

7. A printing system according to claim 1 wherein said at least one ink is a water based ink.

8. A printing system comprising:

a. a printing and drying head including an ink jet printing element and a drying unit adjacent to said ink jet printing element for applying at least one ink to a printing substrate and for immediately drying it; and b. means for moving said printing and drying head with respect to said printing substrate.

9. A printing system according to claim 8 wherein said drying unit of said printing and drying head is an RF drying unit discharging RF energy.

10. A printing system according to claim 9 wherein said at least one RF drying unit comprises:

a. an RF generator for producing RF energy; and b. at least one electrode for discharging said RF energy in the vicinity of said printing substrate.

11. A printing system according to claim 8 further comprising an ink waste disposal system comprising:

a. a collection unit for collecting ink liquid residues; and b. an RF ink waste drying unit for discharging RF energy, thereby to convert said ink liquid residues to a substantially solid ink residue for disposal.

12. A printing system according to claim 8, wherein said printing head includes a plurality of said ink jet printing elements sequentially applying liquid inks of different colors to said substrate; and a plurality of drying units, one for each side of said printing elements for drying the liquid ink applied by its respective printing element before liquid ink is applied by the next printing element in the sequence.

13. A printing system according to claim 8 wherein said at least one ink is a water based ink.

14. A printing method comprising the steps of:

a. applying at least one liquid ink to a printing substrate; by an ink jet printing element located on a printing head; and b. discharging RF energy by an RF drying unit located on said printing head adjacent to said ink jet printing element for immediately drying said at least one ink on said printing substrate.

15. A printing method according to claim 14 further comprising the steps of:

a. collecting into a collection unit ink liquid residues; and b. discharging RF energy towards said collection unit for converting said ink liquid residues to a substantially solid ink residue for disposal.

16. A printing method according to claim 14 wherein said at least one ink is a water based ink.

17. A printing method comprising the steps of:

a. applying at least one liquid ink to a portion of a printing substrate by an ink jet printing element located on a printing head while moving said printing head with respect to said printing substrate; and b. discharging RF energy by an ink jet printing element located on a printing head for immediately drying the ink applied on said portion of said printing substrate.

18. A printing method according to claim 17 further comprising the steps of:

a. collecting into a collection unit ink liquid residues; and b. discharging RF energy towards said collection unit, for converting said ink liquid residues to a substantially solid ink residue for disposal.

19. A printing method according to claim 17 wherein said at least one ink is a water based ink.

* * * * *